United States Patent [19]

Mann

[11] Patent Number: 5,029,633

[45] Date of Patent: Jul. 9, 1991

[54] COOLING POND ENHANCEMENT

[75] Inventor: David O. Mann, Hamilton, Ind.

[73] Assignee: Mann Technology Limited Partnership, Greenville, S.C.

[21] Appl. No.: 336,618

[22] Filed: Apr. 7, 1989

Related U.S. Application Data

[63] Continuation of Ser. No. 140,964, Jan. 4, 1988, abandoned, which is a continuation of Ser. No. 923,343, Oct. 27, 1986, abandoned.

[51] Int. Cl.[5] ..... F28D 15/02

[52] U.S. Cl. ..... 165/45; 165/907

[58] Field of Search ..... 165/45, 907, 45 H; 62/260

[56] References Cited

U.S. PATENT DOCUMENTS

| | | | |
|---|---|---|---|
| 1,209,956 | 12/1916 | Gesell | 122/1 R |
| 2,428,876 | 10/1947 | Hawkins | 165/18 |
| 3,289,756 | 12/1966 | Jaeger | 165/907 X |
| 3,306,353 | 2/1967 | Burne | 165/907 X |
| 3,825,064 | 7/1974 | Inoue | 165/907 X |
| 3,935,900 | 2/1976 | Waters | 165/45 |
| 3,967,675 | 7/1976 | Georgii | 165/45 X |
| 3,990,253 | 11/1976 | Lea, Jr. et al. | 165/45 X |
| 4,036,286 | 7/1977 | Anderson et al. | 165/45 |
| 4,108,156 | 8/1978 | Sitter | 126/271 |
| 4,271,681 | 6/1981 | Schertz | 165/45 X |
| 4,355,522 | 10/1982 | Gorski et al. | 165/45 X |
| 4,375,157 | 3/1983 | Boesen | 165/45 X |
| 4,440,148 | 4/1984 | Assaf | 165/45 X |
| 4,505,326 | 3/1985 | Hazen | 165/45 |
| 4,872,315 | 10/1989 | Assaf | 165/104.14 |

*Primary Examiner*—Ira S. Lazarus
*Assistant Examiner*—Richard R. Cole
*Attorney, Agent, or Firm*—Bailey & Hardaway

[57] ABSTRACT

An improvement to a cooling pond is disclosed which utilizes metallic heat pipes to transmit heat from the cooling pond to the ambient air environment.

3 Claims, 1 Drawing Sheet

FIG. 1
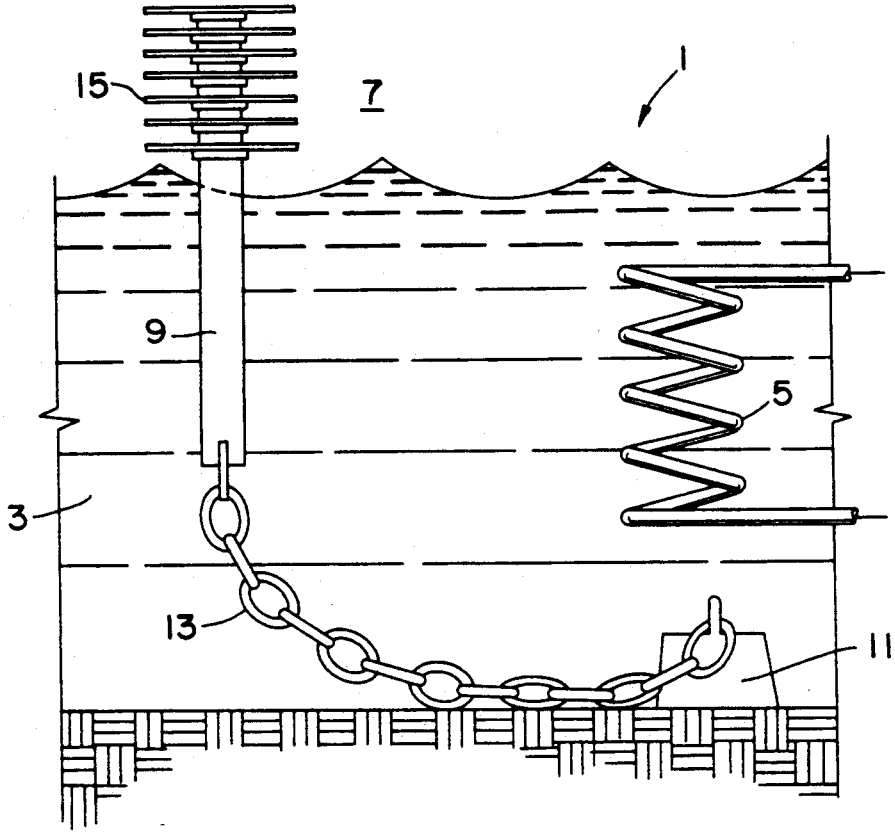
FIG. 2
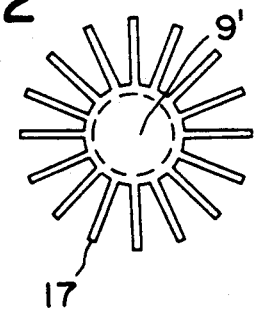
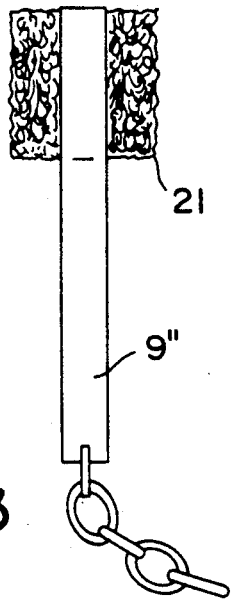
FIG. 3

COOLING POND ENHANCEMENT

This application is a continuation of application Ser. No. 140,964, filed Jan. 4, 1988, now abandoned, which is a continuation of application Ser. No. 923,343 filed Oct. 27, 1986, now abandoned.

BACKGROUND OF THE INVENTION

This invention relates generally to the art of heat exchange and more particularly to an enhancement to improve the cooling ability of cooling ponds.

Cooling ponds are traditionally utilized to conduct heat from heat sources to the ambient atmosphere. Typical applications of cooling ponds include the cooling of compressors of air conditioning units. The heat is normally conducted into the cooling pond by conduction or by exchange of warm water from cooling coils to be replenished by the cooler water of the remaining body of the cooling pond. The cooling pond responds by exchanging the heat thus absorbed to the ambient atmosphere by radiation convection and by the cooling effect of evaporation of the water in the cooling pond into the ambient atmosphere. Such heat exchange between the cooling pond and ambient atmosphere is frequently enhanced by the utilization of fountains which promote additional heat exchange by the mechanisms above described.

While these heat conducting mechanisms have proved generally satisfactory, any enhancement in the cooling efficiency would promote better utilization of such cooling ponds.

SUMMARY OF THE INVENTION

It is thus an object of this invention to provide an enhancement for a cooling pond which increases the ability of such pond to exchange heat with the ambient atmosphere.

This object is accomplished by an improvement to a cooling pond which comprises the placement of a heat pipe through the ambient air water interfaced whereby heat is conducted from the water through the thermal rod to the ambient atmosphere.

BRIEF DESCRIPTION OF THE DRAWINGS

FIG. 1 of the drawings is a schematic view of a heat pipe within a cooling pond.

FIG. 2 is a plan view of a heat pipe of a different embodiment of this invention.

FIG. 3 of the drawings is a cross sectional view of yet another embodiment of this invention.

DETAILED DESCRIPTION

In accordance with this invention, it has been found that thermal efficiency of a cooling pond may be greatly enhanced by utilization within that pond of metallic heat pipes transversing the interface between the cooling pond and the surrounding ambient atmosphere. While this description is given with reference to a cooling pond, which is the preferred embodiment thereof, it is clear that the term cooling pond may apply to any body of liquid which is utilized to transfer heat to a surrounding gaseous atmosphere, i.e. ambient atmosphere. Various other advantages and features will become apparent from the following description given with reference to the various figures and drawing.

FIG. 1 of the drawings illustrates a cooling pond 1 which is a body of water 3 having a source of heat 5 therein. The overall purpose of the cooling pond being to transfer the heat from source 5 to ambient atmosphere 7. The improvement according to this invention comprises the utilization therein of a metallic heat pipe 9 in communication with water 3 and ambient atmosphere 7 to conduct heat from the water or liquid 3 to the ambient atmosphere 7.

The metallic heat pipe 9 for utilization with this invention may comprise a conventional thermal conductor such as a heat pipe. Most preferably, metallic heat pipe 9 is the type of rod identified in my co-pending application, Ser. No. 840,040, filed Mar. 17, 1986. Such thermal conducting rods are normally closed copper tubing, having an appropriate substance within the interior thereof which will vaporize on the warm side and condense on the cool side to greatly enhance thermal conduction through the rod. Such heat pipes, however, are well known in the art.

As illustrated in FIG. 1, metallic heat pipe 9 is buoyed into place by utilization of a weight 11 appropriately selected to have the heat pipe 9 only partially submerged and connected thereto in the conventional buoy technique by connecting means shown here as chain 13.

The heat pipe 9 may be provided with radial fins 15 as illustrated in FIG. 1 or as illustrated at 9' in FIG. 2 as axial fins 17. While fins are only illustrated about the liquid surface in FIG. 1, it is readily apparent that such fins may extend below the liquid surface.

In yet a further embodiment, heat pipe 9'' of FIG. 3 illustrated in cross section illustrates metallic foam 21 for use with such structure.

It is apparent that the improvement of this invention does not deleteriously detract from the appearance of a cooling pond. In fact the cooling fins of metallic foam may be appropriately sculptured to appear as art works upon the surface of a cooling pond while simultaneously enhancing the conduction of heat from the water thereof into the surrounding atmosphere.

It is thus seen that the improvement of this invention greatly enhances the cooling ability of a cooling pond. As many modifications will become apparent to those of skill in the art from reading of the above description, which is exemplary in nature, such modifications are embodied within the spirit and scope of this invention as defined by the following appended claims.

What is claimed is:

1. In a cooling pond acting as a first heat exchange means having a liquid therein and a source of heat in thermal communication with said liquid, the improvement comprising:

a metallic heat pipe acting as a second heat exchange means floating upon and in continued communication with said liquid for transmitting heat from said liquid to an ambient atmosphere and thus cooling said liquid;

said heat pipe comprising a hollow metallic tube having a vaporizable and condensable substance within the hollow thereof; and thereby improving the heat exchanging efficiency of said cooling pond.

2. The improvement according to claim 1 further comprising cooling fins on said heat pipe in thermal communication with said ambient atmosphere.

3. The improvement according to claim 1 further comprising a metallic foam surrounding an upper portion of said heat pipe in communication with said ambient atmosphere.

* * * * *